United States Patent [19]

Reinbold

[11] 4,226,407

[45] Oct. 7, 1980

[54] METALLURGICAL LANCE DESKULLER

[75] Inventor: Richard J. Reinbold, Allentown, Pa.

[73] Assignee: Bethlehem Steel Corporation, Bethlehem, Pa.

[21] Appl. No.: 24,282

[22] Filed: Mar. 26, 1979

[51] Int. Cl.[3] ..... C21C 5/30; C21C 5/32

[52] U.S. Cl. ..... 266/226; 266/225

[58] Field of Search ..... 266/226, 225

[56] References Cited

U.S. PATENT DOCUMENTS

| | | | |
|---|---|---|---|
| 2,747,445 | 5/1956 | McConnell | 81/17.2 |
| 2,822,163 | 2/1958 | McFeaters | 266/226 |
| 3,026,102 | 3/1962 | McFeaters | 266/226 |
| 3,394,928 | 7/1968 | Wiedl | 266/226 |
| 3,907,264 | 9/1975 | Desaar | 266/226 |
| 4,052,044 | 10/1977 | Colling | 266/225 |

*Primary Examiner*—P. D. Rosenberg

*Attorney, Agent, or Firm*—Joseph J. O'Keefe; Charles A. Wilkinson; Michael Leach

[57] ABSTRACT

An apparatus for removing the skull from a metallurgical lance having positioning means mounted on a supporting member, a main arm pivotally fixed to the positioning means, two jaw arms pivotally attached to the main arm, activating means for providing movement to each jaw arm and a guide roller and scraper blade attached to each jaw arm. The apparatus may be enclosed in a housing when not in use. Also electro-pneumatic timing circuitry for automatically operating the apparatus.

12 Claims, 10 Drawing Figures

14
20
22
24
26
28
32
34
36
38
40
42
44
46
48
50
52
54
56
58
60
62
68
78
80
82
84
86
88
90
92
94
98
100
102
112
114
116

METALLURGICAL LANCE DESKULLER

FIELD OF THE INVENTION

This invention relates to apparatus for a basic oxygen furnace and, more particularly, to apparatus for removing skull from metallurgical lances associated with metallurgical furnaces, such as basic oxygen furnaces.

BACKGROUND OF THE INVENTION

In the process for converting iron to steel using the oxygen blowing technique, an overhead water-cooled lance is used to force purified oxygen under high pressure against the surface of the molten metal in a refractory lined, closed bottom converter. While the oxygen lance is inserted within the converter, a sensor lance may also be lowered into and retracted from the converter during the operation to test the melt. Usually these metallurgical lances extend through the hood of a vent or duct system which covers the mouth of the converter to collect for cleaning and scrubbing the hot gases which are generated during the blowing process.

By ejecting the oxygen from the end of the lance at very high velocities, the oxygen impacts the surface of the molten metal which is covered by a layer of slag such that the slag and other molten materials are splashed about within the converter. Some of this molten material contacts the relatively cool outer surface of the metallurgical lances and solidifies there forming what is commonly called a skull. If not removed, the solidified material can quickly accumulate on the lances to the point where the added weight and the increased dimension of the skull-containing lance interfere with efficient operation. The coating may become so thick that the lance cannot be withdrawn from the opening in the hood or so heavy the hoisting means cannot lift the lance. Moveover, if the skulls are not removed from sensor lances after each test, they interfere with the injection of test devices in subsequent tests. This leads to operating downtime to remove the skulls by prying with a bar or cutting with a torch.

An appreciation of the problem created by the presence of skulls on metallurgical lances can be gained from a review of the methods and apparatus which have been devised in attempts to solve this problem. In U.S. Pat. No. 3,394,928 a device is disclosed for clamping a lance, which device holds the lance with sufficient pressure to prevent excessive vibration during blowing and also descales the lance as it is retracted. U.S. Pat. No. 3,575,706 discloses that skull buildup on the lance can be materially reduced or prevented by applying to the lance a coating of an oleaginous composition containing finely divided inorganic particulate matter. A cleaning device is described in U.S. Pat. No. 3,907,264 that comprises a scraping means to contact and scrape the outer surface of the lance as it is raised from the converter to automatically remove adhered material. In U.S. Pat. No. 3,912,244 an oxygen lance is disclosed that has a water spray system incorporated into the structure of the lance including exit water spray nozzles in the wall of the lance barrel for emitting a water spray from the water jacket around the barrel to prevent skull formation. Another method and apparatus for removing encrustations from a metallurgical lance is disclosed in U.S. Pat. No. 4,052,044. A tool is displaced relative to the lance and in contact with the layer of encrustation on the lance. A repetitive movement is applied to the tool against the layer to dislodge it. Some of the prior art devices while attempting to remove a tenaciously adhering skull may gouge the lance or impart such an opposing force that the hoisting mechanism is overstressed.

Consequently, there still exists a need for a reliable apparatus that quickly and efficiently removes a skull from a metallurgical lance.

There is a further need for a deskulling device that prevents digging and gouging on the surface of the lance.

There is yet a further need for an apparatus that does not overstress the lance hoisting system when the skull is welded to the lance and cannot be readily removed.

SUMMARY OF THE INVENTION

The above-mentioned difficulties associated with removing a skull from a metallurgical lance have been obviated by the use of the present invention. I have invented a deskulling apparatus that can be mounted on a supporting member positioned relative to the lance and metallurgical furnace. Broadly the invention is a metallurgical lance deskulling apparatus comprising opposed scraper blades adapted for movement toward and away from a metallurgical lance and guide rollers operatively connected to the scraper blades and arranged to contact the surface of the lance while maintaining the scraper blades a predetermined distance from the surface of the lance which is less than the thickness of skull deposits on the lance.

In a preferred embodiment the apparatus comprises a main arm to which two jaw arms are pivotally attached. Preferably, positioning means, which may be a fluid actuator attached to positioning arms, are mounted on the supporting member and the main arm is fixed to the positioning means. Activating means are secured to the main arm to provide movement to each jaw arm relative to the main arm. A guide roller is rotatably mounted on each jaw arm. A scraper blade is fastened to each jaw arm in a spaced relationship with the roller such that the scraper blade is disposed apart from the lance when the guide roller contacts the lance. Preferably, the scraper blade is yieldably fastened to the jaw arm for movement upward and away from the lance when a skull cannot be dislodged from a retracting lance by the scraper blades. The deskulling device is preferably attached by positioning means to a supporting means comprising a box having spring-loaded doors for enclosing the retracted device when not in use.

DETAILED DESCRIPTION OF THE PREFERRED EMBODIMENT

Figures 1, 2:
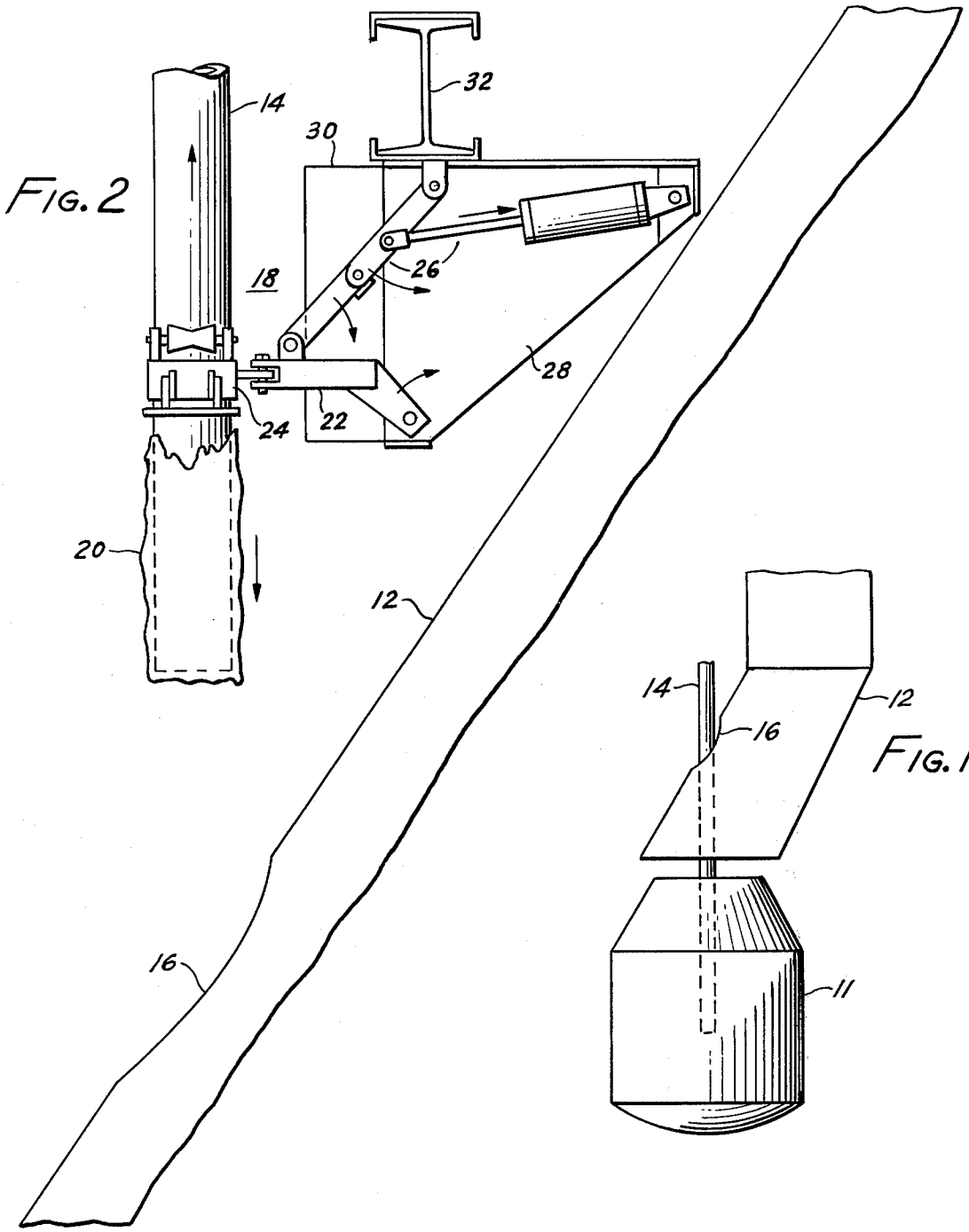
FIG. 1 is a depiction of a typical arrangement of apparatus used in the basic oxygen blowing process.
FIG. 2 shows an embodiment of the invention in deskulling position about the metallurgical lance of FIG. 1.

In the production of steel using the oxygen blowing technique and apparatus as generally depicted in FIG. 1, a refractory-lined converter 11 is charged with molten iron, scrap steel and slag-forming materials. A vent system comprising a hood 12 and associated duct-work is positioned over the mouth of the converter 11 to capture evolved gases and entrained particulates for conveyance to gas cleaning apparatus not shown. A metallurgical lance 14 is inserted into converter 11 through an opening 16 in hood 12. Lance 14 can be the conduit through which purified oxygen is injected into the converter 11 to impinge the molten metal after blowing a pathway through the layer of slag. Lance 14 could also be a sensor lance that is introduced into the melt for analytical testing purposes.

The deskuller apparatus 18 shown generally in FIG. 2 can be constructed and adapted to strip the metal and slag skull 20 from either an oxygen lance or a sensor lance depicted generally in the drawings as metallurgical lance 14. It is to be understood that lance 14 can be either of such lances. Deskuller 18 basically comprises main arm 22 and two jaw arms 24 and preferably also has positioning means identified generally as 26. Deskuller 18 is housed in deskuller box 28 having a pair of doors 30 for enclosing the retracted apparatus to prevent accumulation of furnace slag, dirt and metal particles in the mechanism. The deskuller 18 and the box 28 are secured to supporting member 32. The ability to extend and retract the main arm 22 and the jaw arms 24 into the box 28 using positioning means 26 allows the apparatus to be disposed at a distance relative to the lance 14 so that the lance feeder and hoses, not shown, can pass by without interference on the downward travel of lance 14.

Figure 3:
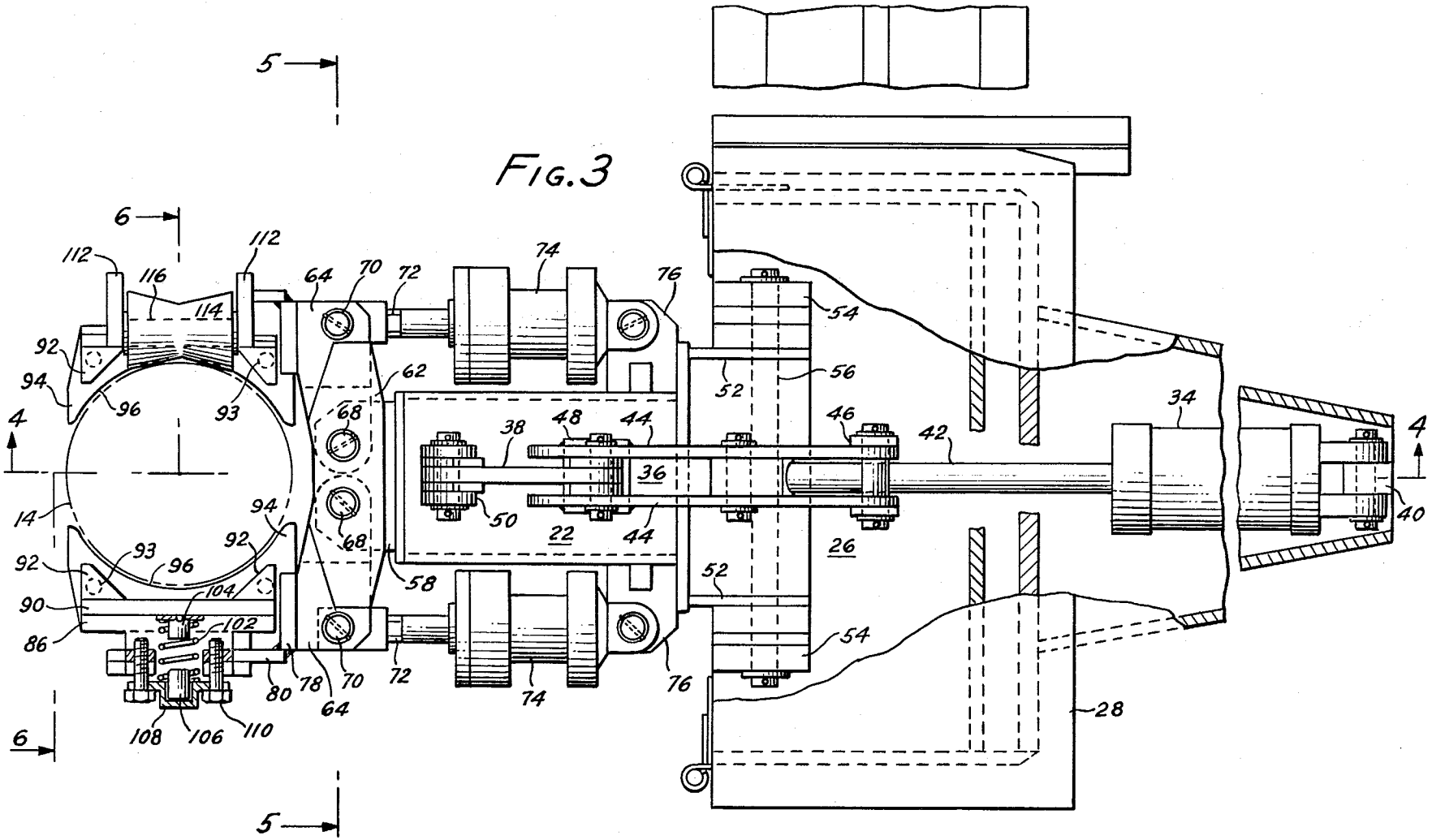
FIG. 3 is a plan view of the embodiment of the invention shown generally in FIG. 2.
Figures 4, 7:
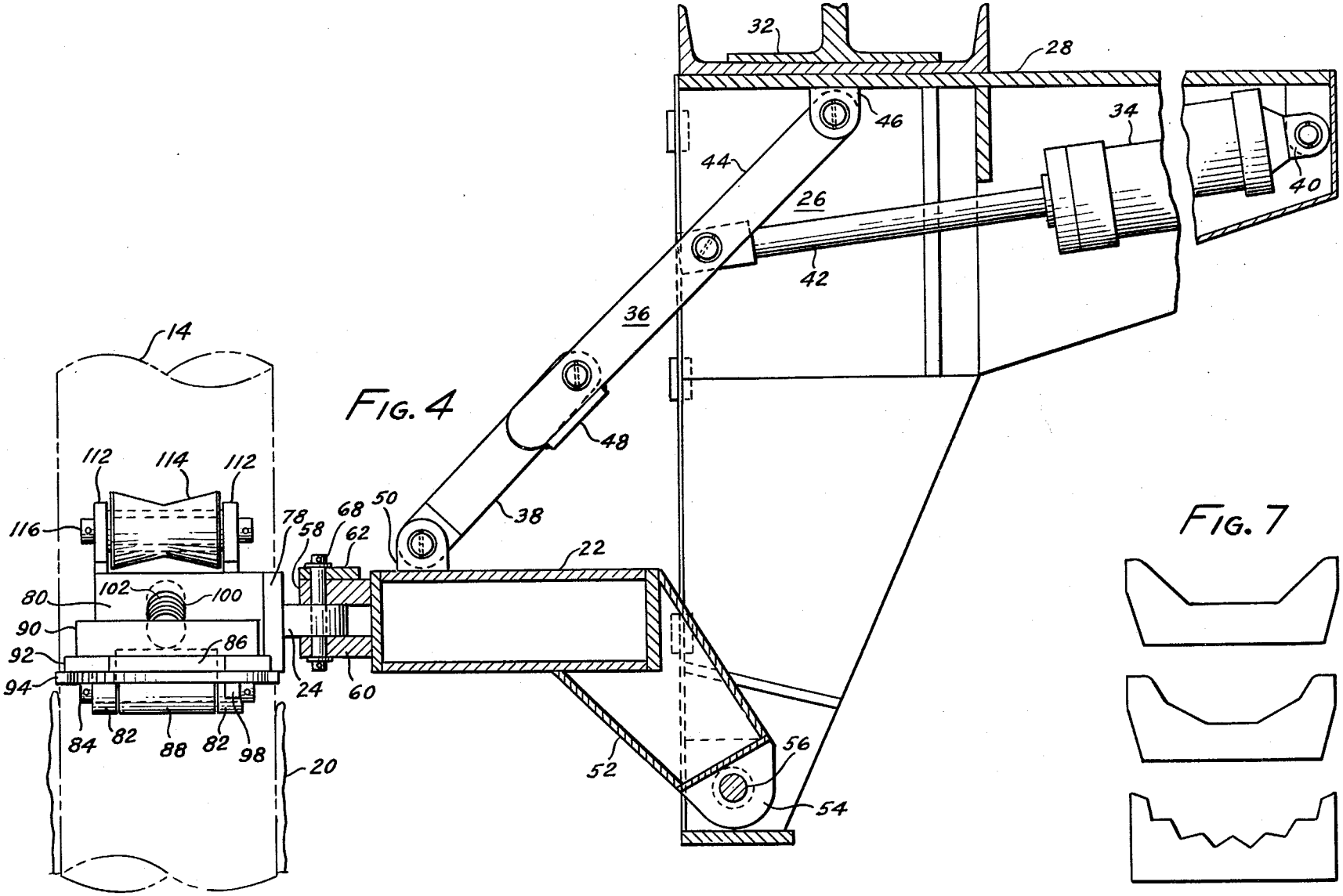
FIG. 4 is a side elevation taken along line 4—4 of FIG. 3.
FIG. 7 shows other embodiments of scraper blades than can be used in the practice of the invention.

Referring to FIGS. 3 and 4 which show the preferred embodiment of the invention, positioning means 26 comprises fluid actuator 34 together with linking arm 36 and linking arm 38 which are the positioning arms. Fluid actuator 34, which may be pneumatically or hydraulically actuated, is hinged at one end by bracket 40 to deskuller box 28 which is in turn secured to supporting member 32. Fluid actuator 34 has actuator rod 42 pivotally secured between parallel members 44 (see FIG. 3) composing linking arm 36 at a point intermediate the ends of members 44. One end of parallel members 44 is swingably attached to the inside of the deskuller box 28 by coupling 46 while the opposite ends are pivotally secured to either side of one end of linking arm 38 to permit movement about the point of attachment. This movement is restricted by self-locking linkage 48 connecting parallel members 44 of linking arm 36. The other end of linking arm 38 is fastened by yoke 50 in a hinged manner to the top of main arm 22.

Figure 5:
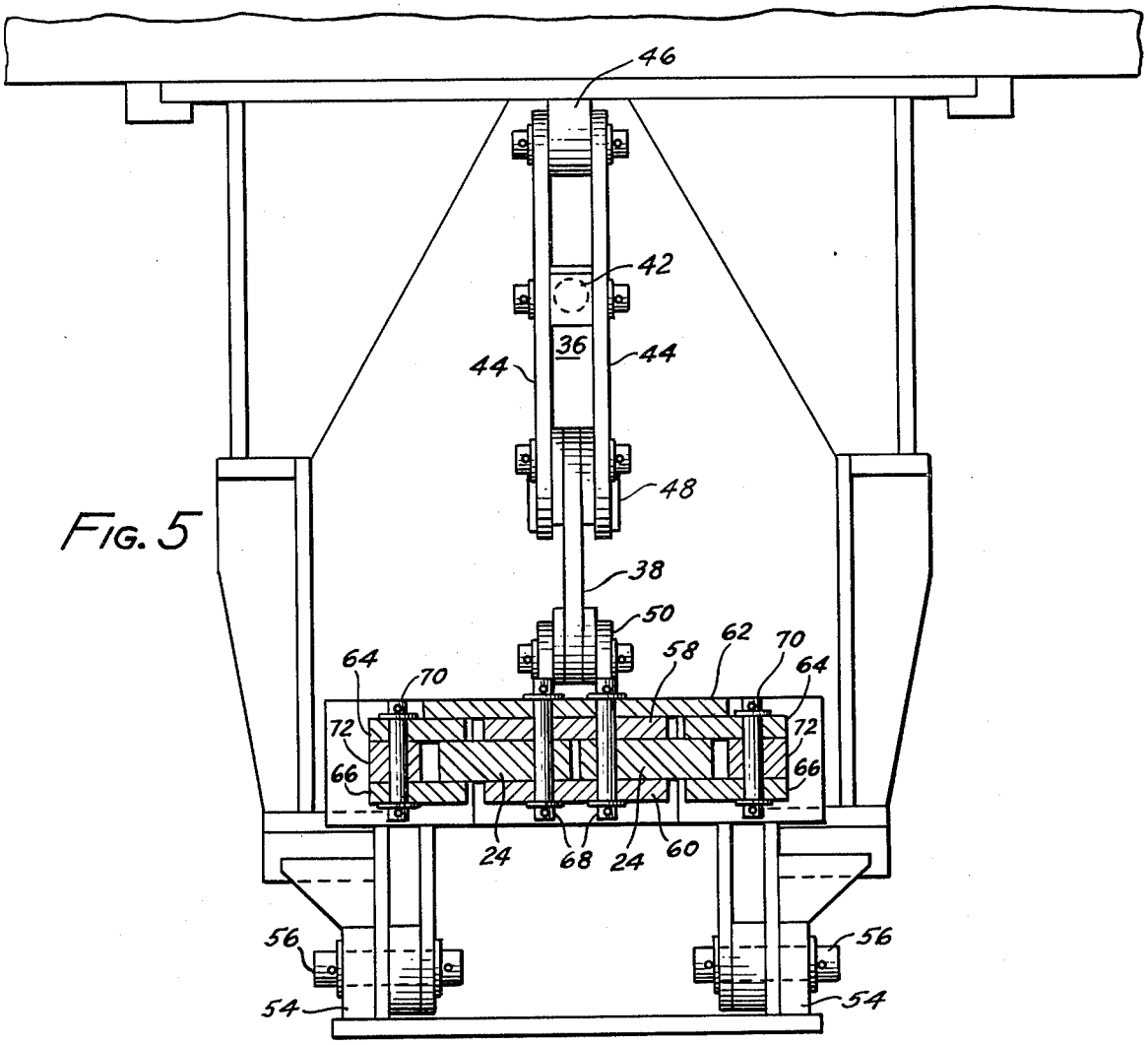
FIG. 5 is a sectional view taken along line 5—5 of FIG. 3.

Extending at a downward angle from either side of one end and composing part of main arm 22 are two legs 52 which are pivotally attached to the bottom of deskuller box 28 via brackets 54 and fastening rod 56. Reinforcing plates connecting the legs may be added to strengthen the structure. The opposite end of main arm 22 bifurcates into horizontal upper and lower holding members 58 and 60 (see FIG. 4). With reference to FIGS. 4 and 5 a supporting top plate 62 is secured to the top side of upper holding member 58. Forked jaw arms 24, which have prongs 64 and 66 (see FIG. 5) are sandwiched between holding members 58 and 60. A supporting bottom plate, not shown, comparable to top plate 62 may be attached to the underside of lower holding member 60. Although pins 68 pass through the concentrically aligned openings in top plate 62, holding members 58 and 60, and jaw arms 24 to fasten these elements together, jaw arms 24 are nevertheless individually capable of pivotal movement about pins 68. Pivotally held by pin 70 in the slot between prongs 64 and 66 of each jaw arm 24 is a rod 72 which, as shown in FIG. 3, extends from an activating means 74 the opposite end of which is clamped by brackets 76 to the side of main arm 22. Activating means 74 may comprise pneumatic or hydraulic compression cylinders. Pins 68 and 70 preferably have borings and are adapted via these borings to permit lubrication of the elements that pivot about these pins.

Figure 6:
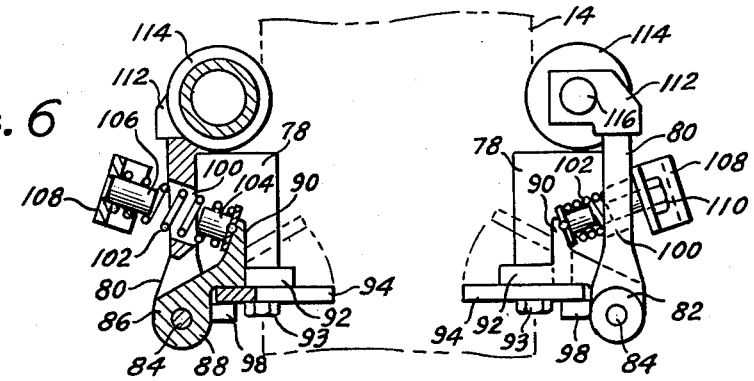
FIG. 6 is a sectional view taken along line 6—6 of FIG. 3.

Referring now to FIGS. 3, 4 and 6 an L-shaped jaw arm frame comprising frame plates 78 and 80 is welded to each jaw arm 24 and prongs 64 and 66. Located on the underside of jaw arm frame plate 80 are two spaced hinge barrels 82 having bores in alignment to receive rod 84. Blade holder 86 comprises cylindrical section 88, upright flange 90 and bracers 92. When the cylindrical section 88 is disposed between the hinge barrels 82, the bore of cylindrical section 88 is coaxial with those of hinge barrels 82 so that the blade holder 86 can swivel about inserted rod 84. Scraper blade 94 is detachably bolted to the underside of blade holder 86 by bolts 93 which pass into bracers 92. The blade 94 has arcuate inner edge 96 which should preferably have a slightly larger radius of curvature than the lance. A stop 98 is welded to a hinge barrel 82 of jaw arm frame plate 80 to restrict the movement of blade holder 86 about rod 84 by contacting the underside of scraper blade 94 and holding it in a position substantially perpendicular to jaw arm frame plate 80.

Passing through an inclined hole 100 in jaw arm frame plate 80 is compression spring 102 which at one end internally receives rod 104 welded to a notch in flange 90 of blade holder 86. A washer is disposed about rod 104 between spring 102 and upright flange 90. Rod 106 is welded to cover 108 which is bolted to jaw arm frame plate 80 so that rod 106 inserts within the coils of spring 102 whereby the spring biases between the blade holder 86 and jaw arm frame plate 80 via cover 108. The means for bolting cover 108 to jaw arm frame plate 80 are adapted to permit the compression of spring 102 to be adjusted by turning bolts 110. The compression of spring 102 serves to yieldably bias the scraper blade holder 86 in a position such that the scraper blade 94 is approximately horizontal and extending towards the lance. Any other suitable biasing means known to an ordinary skilled worker can be used for yieldably mounting the scraper blade holder 86.

Fixed to the top of frame plate 80 are keepers 112 which rotatably support guide roller 114 on axial rod 116. The keepers 112 and guide roller 114 are positioned on the jaw arm frame plate 80 such that when the roller 114 contacts the lance 14 the inner arcuate edge 96 of scraper blade 94 is disposed in close, but non-contacting proximity to the surface of the lance 14.

In operation, when a metallurgical lance that had been inserted into a converter 11 is to be retracted, fluid actuator 34 is activated to advance actuator rod 42 causing linking arm 36 and linking arm 38 to extend into alignment. Concomitantly, main arm 22 pivots outwardly from deskuller box 28 to place jaw arms 24 in a transverse position across the lance 14. Next, activating means 74 propel rods 72 forward moving jaw arms 24 toward lance 14 until guide rollers 114 contact the sides of the lance 14 and are forceably held in place while still allowing longitudinal movement of the lance between the rollers. The jaw arms close around the lance to form a substantially circular scraping edge. Scraper blades 94 are now positioned so that the arcuate blade edge 96 is disposed slightly away from the lance surface, preferably with a 1/32 to 1/16 inch (0.079 to 0.159 cm) set back or space between the edge 96 of the blade and the surface of the lance 14. As the lance is withdrawn, this spacing of the scraper blade 94 from the lance prevents digging and gouging of the surface of the lance. As the lance retracts, it moves smoothly between the guide rollers 114 with the skull 20 on the end of the lance eventually impacting the scraper blades 94. Continued upward movement of the lance disengages the skull 20 which slips downward from the end of the lance and into the converter 11. Preferably jaw arms should be closed about a clean surface of the lance before the blades impact the skull. Otherwise, the guide rollers will contact and ride on the skull. In such a situation the scraper blades can only remove the skull if the blades make contact with any of the numerous bumps and projections on the skull surface.

When the lance is fully retracted, rods 72 are withdrawn into activating means 74 pulling jaw arms 24 into an open position. Next actuator rod 42 retreats into fluid actuator 34 drawing the deskuller into the deskuller box 28 with the closing of the spring-hinged doors not shown. Box 28 should be provided with a hole in the bottom so that any piece of skull which adheres to the blades and falls off in the box will pass out the hole without thermally damaging the device.

The scraping blades 94 are preferably detachably bolted to blade holder 86. The scraping blades, however, may alternatively be directly secured to the jaw arm frame in a non-biased manner, again with the proviso that the scraper blades are positioned relative to the rollers so that the blade edge is somewhat set back from the surface of the lance. Preferably the scraper blade edge is arcuate in order to present a substantially mating configuration with the lance without actual contact between the two. However, the scraper blade may be machined to possess a scraping edge of any configuration desired, such as those variations shown in FIG. 7 by way of example.

However, the scraper blades are preferably yieldably mounted for upward pivotal movement as set forth in the above-detailed description of the spring-loaded embodiment. Any biasing means of attachment between the scraper blade and the jaw arm are contemplated to be within the scope of this invention. This particular feature of the apparatus offers a considerable degree of safety.

To illustrate this point consider the situation in which a skull adheres tenaciously to a retracting metallurgical lance and will not slip or peel away from the lance. A danger of overstress on the cables and components of the lance hoist system as well as potential damage to a deskulling device not having spring-loaded scraper blades is presented by forceably pulling the skull containing lance upward against the deskuller. There even exists the possibility of the lance tearing loose from the cables to plunge into the molten material within the converter.

Being spring-loaded the scraper blades can pivot upwardly, as shown by the dotted lines in FIG. 6, to permit a skull which is "cemented" onto the lance to pass upwardly through the jaw arms. The spring force is adjustable to provide a safety margin for the particular hoist system. In addition, if the full pivot of the scraper blades is insufficient to allow the skull to pass through, the skull will be imparting to the scraper blades and blade holders an angular force consisting of a vertical and a horizontal component. The horizontal component of the angular force will overcome the countering force applied by the jaw arm activating means causing the jaw arms to part into the open position. Consequently, the skull containing lance can readily pass through. In practice the compression springs which are adjustable over a range of tension are usually set to impart 500–1000 lb downward force to each scraper blade and the pneumatic cylinders of activating means 74 are each supplied with 40–100 lb/in$^2$ air pressure. Thus, when a retracting lance with a cemented skull begins to exert a force of about 500 lb., the scraper blades will start yielding. At 1000 lb the blades will be in a fully yielded position and when the horizontal closing force imparted by the pneumatic cylinder to the jaw arms is exceeded, the jaw arms open to pass the lance and skull.

In actuality, the preferred embodiment as revealed in FIGS. 3–6 was pneumatically powered. An electropneumatic timing circuit was adapted to automatically operate the device for removing skulls from a sensor lance which, in its retracted position, can be moved transversely away from the converter. The control scheme contains interlock switches to prevent movement of the lance in any direction other than up when the deskuller is in use. The pneumatic control scheme and the electrical control scheme are presented in FIGS. 9 and 10 respectively.

Figure 9:
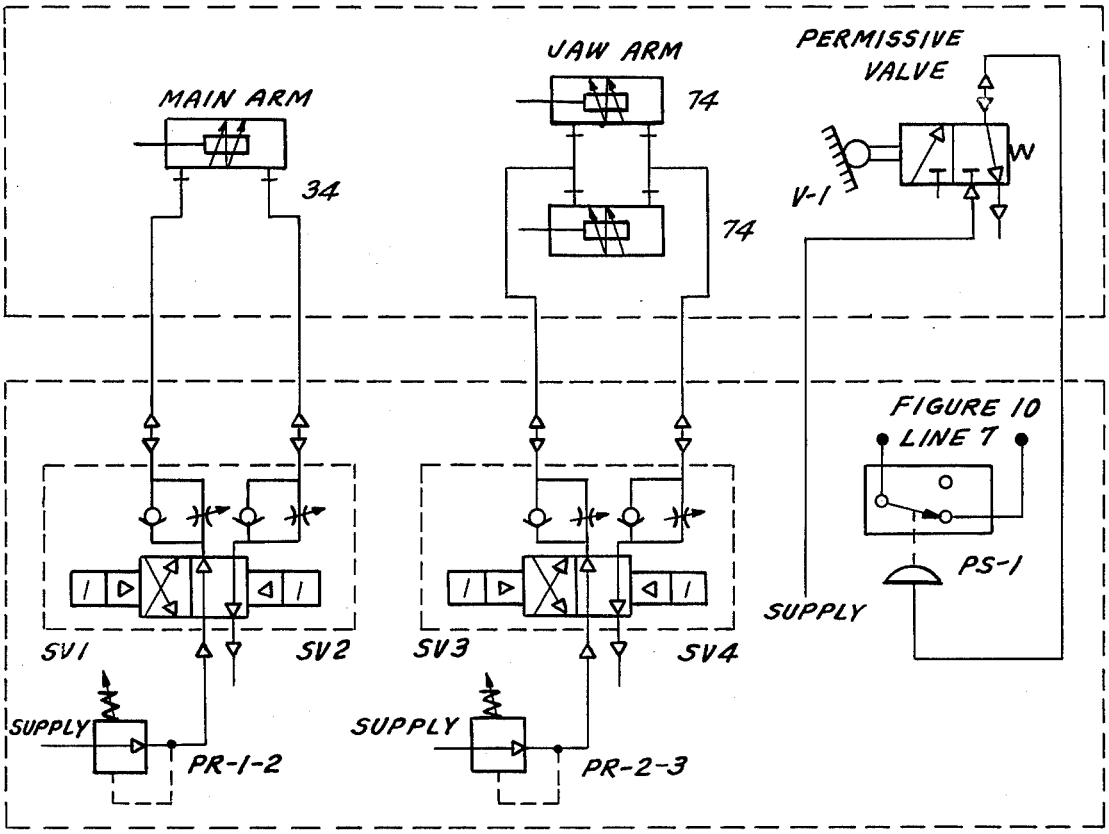
FIG. 9 is a schematic of a pneumatic control circuitry united with the embodiment of FIGS. 3–6.
Figure 10:
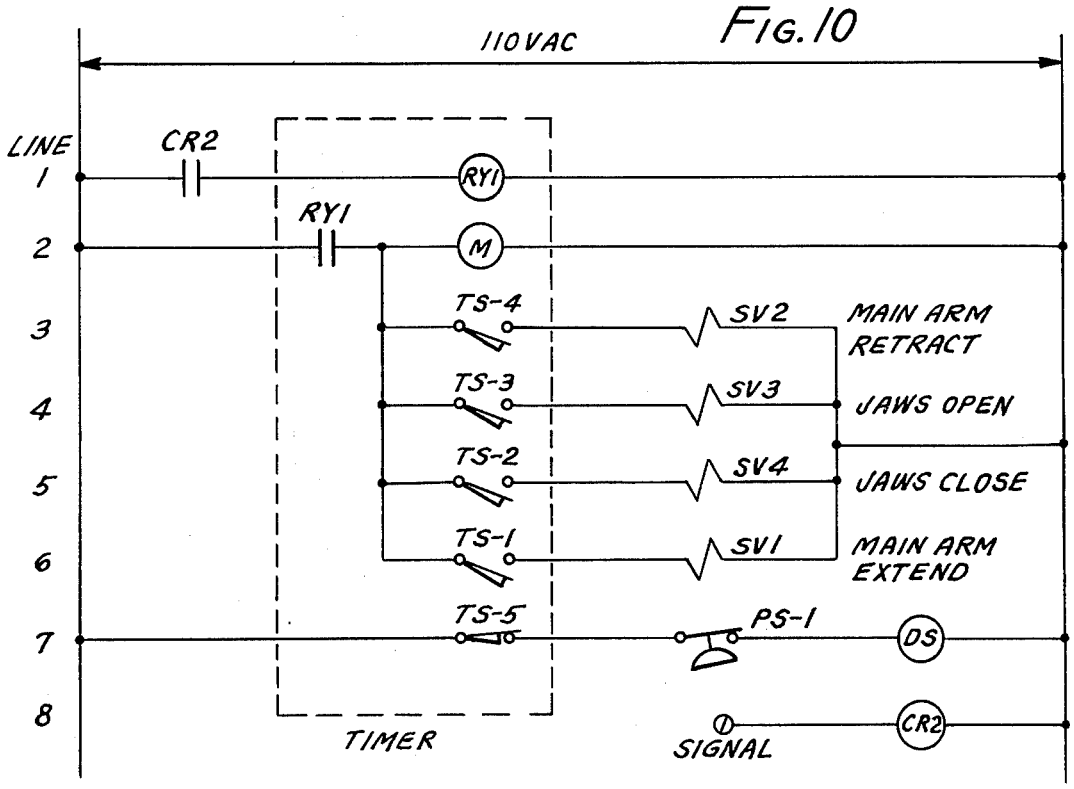
FIG. 10 is a schematic of an electrical control circuitry associated with the pneumatic control circuitry of FIG. 9.

With respect to FIGS. 9 and 10, the operation of the preferred embodiment of the deskulling apparatus will now be described. The sensor lance 14 is lowered into the metallurgical furnace 11 for a test, a total travel of about 650 in. (1651 cm). The lance is started upward after the test. At a point of 300 in. (762 cm) of upward travel, 350 in. (889 cm) remaining, an electrical signal is received from the hoisting apparatus and activates relay CR2 in the deskuller control system. The skull on the lance is usually located in the last 200 in. (508 cm) of the hoisting distance, or equivalently the bottom 200 in. (508 cm) of the length of the lance. Contacts CR2 close and activate latching relay RY1 to start the timer motor M which has five cam-operated electrical limit switches. Cam electrical-switch TS-5 opens and deactivates relay DS which opens remote electrical contacts in the lance traverse circuit so that, as a safety feature, the lance cannot be traversed away for 25 seconds. Cam electrical-switch TS-1 activates an electrical air-valve SV-1 to extend the main arm cylinder (fluid actuator 34). This movement of the apparatus out of the box triggers an air valve V-1 which opens pressure switch PS-1 to remove the ability to traverse the lance. Cam electrical-switch TS-2 activates an electrical air-valve SV-4 to extend the jaw arm cylinders (activating means 74) thereby closing the jaw arms 24 so that the guide rollers contact the lance. Deskulling can now proceed as the lance is further retracted. After the lance has completed its upward travel, cam electrical-switch TS-3 activates electrical air-valve SV-3 to retract the jaw arm cylinders (activating means 74) to open the jaw arms 24. Cam electrical-switch TS-4 activates electrical air-valve SV-2 to retract the main arm cylinder (fluid actuator 34) pulling the apparatus back into the housing box. The pressure valve V-1 resets pressure switch PS-1 for permission to traverse. Cam electrical-switch TS-5 closes and reinstates the sensor lance traverse circuit and the lance 14 is traversed away.

Figure 8:
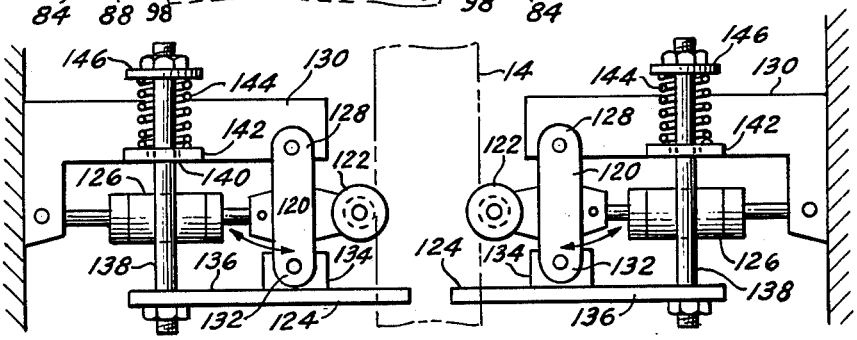
FIG. 8 is another embodiment of the invention.

Yet another embodiment of the invention is shown in FIG. 8 depicting apparatus comprising opposed scraper blades which are adapted for movement toward and away from the metallurgical lance and guide rollers operatively connected to the scraper blades. The guide rollers are spatially arranged to contact the surface of the lance while keeping the scraper blades a predetermined distance from the surface of the lance. This distance is less than the thickness of the skull deposited on the lance.

The deskulling apparatus of FIG. 8 has two substantially opposed arms 120 each having a guide roller 122 which is rotatably mounted. A scraper blade 124 is fixed to each arm 120 in a spaced relationship with the guide roller 122 so that the scraper blade 124 is slightly set back a predetermined distance from the lance 14 when the guide roller 122 contacts the lance. Attached to the arms 120 are means 126 for imparting coacting individual movement to the arms 120 in order to move the scraper blades 124 to a position transversely surrounding the lance 14 with the rollers 122 contacting the lance.

Advantageously, the scraper blades are yieldably mounted in the embodiment of FIG. 8 in the following manner. Arm 120, on which guide roller 122 is rotatably mounted, has its upper end 128 pivotally secured to support member 130 and its lower end 132 pivotally secured by holder 134 to scraper blade 124 which has an extended portion 136 opposite the end that contacts the skull. Means 126 which may be pneumatic cylinders, are attached between each arm 120 and its associated support member 130 for moving the cooperatively connected guide rollers 122 and scraper blades 124 into a position transversely surrounding the lance with the guide rollers 122 contacting the lance while the scraper blades 124 are set back a predetermined distance. Fastened to the extended portion 136 of the scraper blade is one end of rod 138 which is inserted through a hole 140 in support member 130, spring keeper 142 which rests on the bottom of support member 130 and coiled spring 144 which is retained in position by fastener 146. When a cemented skull on retracting lance 14 exerts an upward force on the scraper blade 124 causing it to pivot about the point of attachment between arm 120 and holder 134 with scraper blade end 136 lowering and pulling down rod 138 which, in turn, compresses spring 144, the scraper blades will part sufficiently to pass the skull.

While particular embodiments of the present invention have been shown and described, it is apparent that various changes and modifications may be made, and it is therefore intended in the following claims to cover all such modifications and changes as may fall within the true spirit and scope of this invention.

I claim:

1. In combination with a metallurgical lance and a metallurgical furnace an apparatus for removing a skull adhering to the metallurgical lance comprising (a) positioning means secured to a supporting member, (b) a main arm fixed to the positioning means, (c) two jaw arms pivotally attached to the main arm, (d) activating means mounted on the main arm for providing movement to each jaw arm to close the jaw arms about the lance, (e) a guide roller rotatably mounted on each jaw arm in a position such that the guide rollers contact the surface of the lance when the jaw arms close about the lance, and (f) a scraper blade attached to each jaw arm in a position on the jaw arms relative to the roller such that the scraper blade is spaced from the surface of the lance when the roller contacts the surface of the lance.

2. The invention of claim 1 including (g) means for yieldably attaching the scraper blade of subparagraph (f) to the jaw arm for upward movement.

3. The invention of claim 2 in which the positioning means includes a fluid actuator attached to positioning arms.

4. The invention of claim 2 in which the means of subparagraph (g) for yieldable attaching the scraper blade comprises a compression spring biased between the scraper blade and the jaw arm which are pivotally attached to each other.

5. The invention of claim 4 in which the activating means of subparagraph (d) is a pneumatic cylinder for each jaw arm.

6. The invention of claim 4 in which the means of subparagraph (g) for yieldably attaching the scraper blade further comprises (i) a jaw arm frame attached to the jaw arm possessing on its underside two hinge barrels having bores that are aligned, (ii) a blade holder having a cylindrical section coaxial with and disposed between the hinge barrels of the jaw arm frame and an upright flange, (iii) a rod inserted through the hinge barrels of the jaw arm frame and the cylindrical section of the blade holder to permit the blade holder to swivel relative to the jaw arm frame, (iv) a stop fixed to one barrel to restrict the movement of the blade holder about the rod by contacting the scraper blade, and (v) a compression spring passing through a hole in the jaw arm frame, the spring being secured at one end to the blade holder and at the other end to the jaw arm frame whereby the spring biases between the blade holder and the jaw arm frame.

7. The invention of claim 1 in which the supporting member is a box for housing the apparatus.

8. In combination with a metallurgical lance and metallurgical furnace an apparatus for removing a skull adhereing to the metallurgical lance comprising (a) a main arm, (b) two jaw arms pivotally attached to the main arm, (c) activating means mounted on the main arm for providing movement to each jaw arm to close the jaw arms about the lance, (d) a guide roller rotatably mounted on each jaw arm in a position such that the guide rollers contact the surface of the lance when the jaw arms close about the lance, and (e) a scraper blade attached to each jaw arm in a position on the jaw arm relative to the guide roller such that the scraper blade is spaced from the surface of the lance when the roller contacts the surface of the lance.

9. The invention of claim 8 in which the scraper blade is yieldably attached to the jaw arm.

10. In combination with a metallurgical lance and metallurgical furnace an apparatus for removing a skull from the metallurgical lance comprising (a) two arms, (b) a guide roller rotatably mounted on each arm, (c) means attached to the arms for imparting coacting individual movement to the arms to bring the guide rollers into contact with the surface of the lance, and (d) a scraper blade attached to each arm in a position relative to the guide roller such that the scraper blades are in a position transversely surrounding the lance and spaced from the surface of the lance when the rollers contact the lance.

11. The apparatus of claim 10 in which the scraper blades are yieldably attached to the arms.

12. A metallurgical lance deskulling apparatus for removing skull deposits adhering to a metallurgical lance comprising:

(a) opposed scraper blades adapted for movement toward and away from the metallurgical lance, and (b) guide rollers operatively connected to the scraper blades and arranged to contact the surface of the lance while maintaining the scraper blades a predetermined distance from the surface of the lance which distance is less than the thickness of the skull deposits on the lance.

* * * * *